US010808708B2

(12) United States Patent
Xu

(10) Patent No.: US 10,808,708 B2
(45) Date of Patent: Oct. 20, 2020

(54) CUP-COVER FAN AND WATER CUP THEREOF

(71) Applicant: Wenlong Xu, Shenzhen (CN)

(72) Inventor: Wenlong Xu, Shenzhen (CN)

( * ) Notice: Subject to any disclaimer, the term of this patent is extended or adjusted under 35 U.S.C. 154(b) by 212 days.

(21) Appl. No.: 16/157,107

(22) Filed: Oct. 11, 2018

(65) Prior Publication Data

US 2019/0075950 A1 Mar. 14, 2019

Related U.S. Application Data

(63) Continuation of application No. PCT/CN2018/072686, filed on Jan. 15, 2018.

(30) Foreign Application Priority Data

May 25, 2017 (CN) ..... 2017 2 05986463 U
Oct. 24, 2017 (CN) ..... 2017 1 10023183

(51) Int. Cl.

| | |
|---|---|
| ***F04D 25/08*** | (2006.01) |
| ***A47G 19/22*** | (2006.01) |
| ***A45F 3/18*** | (2006.01) |
| ***A47G 21/18*** | (2006.01) |

(52) U.S. Cl.

CPC ..... *F04D 25/084* (2013.01); *A45F 3/18* (2013.01); *A47G 19/2288* (2013.01); *A47G 21/18* (2013.01); *A47G 21/186* (2013.01); *A47G 21/187* (2013.01); *B65D 2543/00046* (2013.01); *F04D 25/088* (2013.01)

(58) Field of Classification Search

CPC .... A47G 21/18; A47G 21/186; A47G 21/187; A47G 19/2288; A45F 3/18; B65D 2543/00046; F04D 25/084

USPC ..... 220/707–709

See application file for complete search history.

(56) References Cited

U.S. PATENT DOCUMENTS 5,062,281 A * 11/1991 Oliphant ..... F24F 5/0017 62/406
5,209,010 A * 5/1993 Vickery ..... A01M 1/02 43/139
6,161,777 A * 12/2000 Carter ..... A45F 3/16 239/222.11

(Continued)

FOREIGN PATENT DOCUMENTS

CN 2810401 Y 8/2006
CN 201337247 Y 11/2009

(Continued)

OTHER PUBLICATIONS

Written Opinion of the International Searching Authority.
International Search Report for PCT/CN2018/072686.

*Primary Examiner* — Christopher S Bobish

(57) ABSTRACT

A cup-cover includes a base, a fan blade assembly positioned on an upper portion of the base, a PCB and a power supply respectively connected to the fan blade assembly and received in the base. The base includes a cap portion formed on a bottom thereof to cover a rim of a cup. The fan blade assembly includes a fan housing and an impeller installed in the fan housing. The fan housing is rotatably connected with the base by a connecting member to achieve opening and closing between the fan housing and an upper surface of the base via the fan housing foldably rotating along the connecting member to adjust wind direction of the cup-cover fan.

34 Claims, 9 Drawing Sheets

(56) References Cited

U.S. PATENT DOCUMENTS

| | | | | |
|---|---|---|---|---|
| 7,143,958 | B1 | 12/2006 | Dorney | |
| 7,607,592 | B1 * | 10/2009 | Kim | A01G 25/14 239/377 |
| 7,810,794 | B2 * | 10/2010 | Chen | B05B 11/3057 261/28 |
| 9,848,720 | B2 * | 12/2017 | Yekutiely | G06Q 50/12 |
| 10,368,666 | B2 * | 8/2019 | Yekutiely | G06F 16/9535 |
| 2007/0077140 | A1 * | 4/2007 | Silberfenig | F04D 25/084 415/121.3 |
| 2008/0302711 | A1 * | 12/2008 | Windmiller | B65D 47/24 210/137 |
| 2018/0079561 | A1 * | 3/2018 | Savenok | B65D 43/0212 |

FOREIGN PATENT DOCUMENTS

| | | | |
|---|---|---|---|
| CN | 201938952 | U | 8/2011 |
| CN | 202843163 | U | 4/2013 |
| CN | 204105622 | U | 1/2015 |

* cited by examiner

CUP-COVER FAN AND WATER CUP THEREOF

CROSS-REFERENCE TO RELATED APPLICATION

The present application is a continuation-application of International Application PCT/CN2018/072686, with an international filing date of Jan. 15, 2018, which claims foreign priority of Chinese Patent Application No. 2017205986463, filed on May 25, 2017, and Chinese Patent Application No. 2017110023183, filed on Oct. 24, 2017, in the State Intellectual Property Office of China, the contents of all of which are hereby incorporated by reference.

BACKGROUND

1. Technical Field

The present disclosure generally relates to fans field, and especially relates to a cup-cover fan and a water cup thereof.

2. Description of Related Art

In outdoor sports, people often carry water cups, especially for those who enjoy strenuous sports such as cycling and climbing outdoors, water cups are indispensable to their carry-on products. A conventional water cup with a fan is available with its patent NO. CN 201480873U. This kind of cup-cover type cup has the following disadvantages: 1) it is inconvenient to be received and select and position multi-angle wind directions; 2) it is inconvenient to drink; 3) fan blades are fully exposed without being protected to easily cause safety problems; 4) the entire blades can't be covered to maintain aesthetic and anti-fall applicability. To sum up, this kind of cup is greatly needed to be improved. However, the dimension of a matching cup-cover fan is limited by a finite diameter of the water cup. In this way, in order to achieve a variety of functions within a narrow range, such as convenient storage, multi-angle adjustment, protection of fan blades, safe usage, easy to drink and beautiful appearance, some structures, combinations, or designs that are thought to be well known are actually required very difficult technical considerations for one of ordinary skill in the related art. So, how to improve the structure of the water cup with a fan which can be really applied to the market is an urgent technical problem to be solved.

SUMMARY

The technical problems to be solved: in view of the shortcomings of the related art, the present disclosure relates to a cup-cover fan and a water cup thereof which can achieve opening and closing between a fan housing and an upper surface of a base via the fan housing foldably rotating along a connecting member to further adjust wind direction of the cup-cover fan.

The technical solution adopted for solving technical problems of the present disclosure is:

a cup-cover fan includes a base, a fan blade assembly positioned on an upper portion of the base, a PCB and a power supply respectively connected to the fan blade assembly and received in the base. The base includes a cap portion formed on the bottom thereof to cover a rim of a cup. The fan blade assembly includes a fan housing and an impeller installed in the fan housing. The cap portion is a sleeving portion arranged on the periphery of the rim of the cup or a sleeve arranged inner of the rim of the cup. The fan housing is rotatably connected with the base by a connecting member to achieve opening and closing between the fan housing and an upper surface of the base via the fan housing foldably rotating along the connecting member to further adjust wind direction of the cup-cover fan.

Wherein a straw is mounted on the base and connected with a cup body, a suction nozzle end of the straw configured to move to control opening and closing of the straw.

Wherein the suction nozzle end is installed in a chamber of the base, and the chamber includes an opening f that the suction nozzle end can be exposed therefrom when the straw is in an open state.

Wherein the straw includes a main body extending into the cup body and connected under a through-water hole of the base so that the suction nozzle end can move to control correspondence and dislocation of an inlet of the suction nozzle end and the through-water hole.

Wherein the suction nozzle end includes an inner end rotatably installed in the chamber, and the through-water hole and the inlet are eccentrically arranged each other relative to an axis of the inner end so that the suction nozzle end can rotate back and forth to realize correspondence and dislocation of the inlet and the through-water hole.

Wherein the suction nozzle end is a bendable hose and the base includes a limiting portion for limiting the suction nozzle end in a bent state.

Wherein the chamber includes a back plate for bearing force when the suction nozzle end is bent, and the limiting portion is a pushing plate movably installed in the opening of the chamber and can move back and forth to bend and release the suction nozzle end.

Wherein the suction nozzle end includes a hard tube portion formed on an outer end thereof, and the limiting portion is a protrusion formed on the chamber, with the hard tube portion corresponding to the protrusion during in the bent state of the suction nozzle end.

Wherein the cup-cover fan further includes an upper cover covered on the base.

Wherein the base includes a plurality of limiting blocks arranged on an outer wall thereof at intervals, and the upper cover includes a plurality of fixing blocks formed on an inner wall thereof to engage with corresponding limiting blocks, a space between each two adjacent limiting blocks is sufficient for entry and exit of a corresponding fixing block so that the upper cover can rotate to perform clamp connection of the limiting block and the fixing block.

Wherein the upper cover includes a window formed on a side wall thereof to match with the opening of the chamber, and the upper cover is rotated to achieve correspondence and dislocation of the window and the opening.

Wherein a heat insulating chamber is formed between the cap portion and the PCB and the power supply.

Wherein the connecting member includes a rotating member formed on the fan housing, an installing portion formed on the base to movably engage with the rotating member, and a limiting member provided for stabilizing a rotation angle of the rotating member.

Wherein the installing portion is a horizontal fixing shaft formed on the base and the rotating member is a rotating frame formed on the fan housing and passing through the horizontal fixing shaft, and the limiting member includes a plurality of horizontal ridges formed on an outer surface of the rotating frame and a fixing plate formed on the base to suitably embed into a corresponding horizontal ridge.

Wherein the rotating member is a horizontal rotating shaft formed on the fan housing, the installing portion is a shaft hole formed on the base, and the limiting member is an elastic gasket abutting against the horizontal rotating shaft.

Wherein a clasp structure is respectively formed on an opening and closing side of the fan housing and the base to be mutually matched with each other.

Wherein the base further includes an air hole connected with the cup body and a movable valve formed below the air hole to control opening and closing of the straw according to an actual usage state of the straw.

A water cup according to an exemplary embodiment of the present disclosure includes a cup body and a cup-cover fan as shown above to connect to a rim of the cup.

The present disclosure provides the advantages as below.

The fan housing of the present disclosure can rotatably connected with the base by a connecting member to achieve opening and closing between the fan housing and an upper surface of the base via the fan housing foldably rotating along the connecting member to further adjust wind direction of the cup-cover fan, which is convenient to be operated.

BRIEF DESCRIPTION OF THE DRAWINGS

Many aspects of the embodiments can be better understood with reference to the following drawings. The components in the drawings are not necessarily dawns to scale, the emphasis instead being placed upon clearly illustrating the principles of the embodiments. Moreover, in the drawings, like reference numerals designate corresponding parts throughout the several views.

Figure 1:
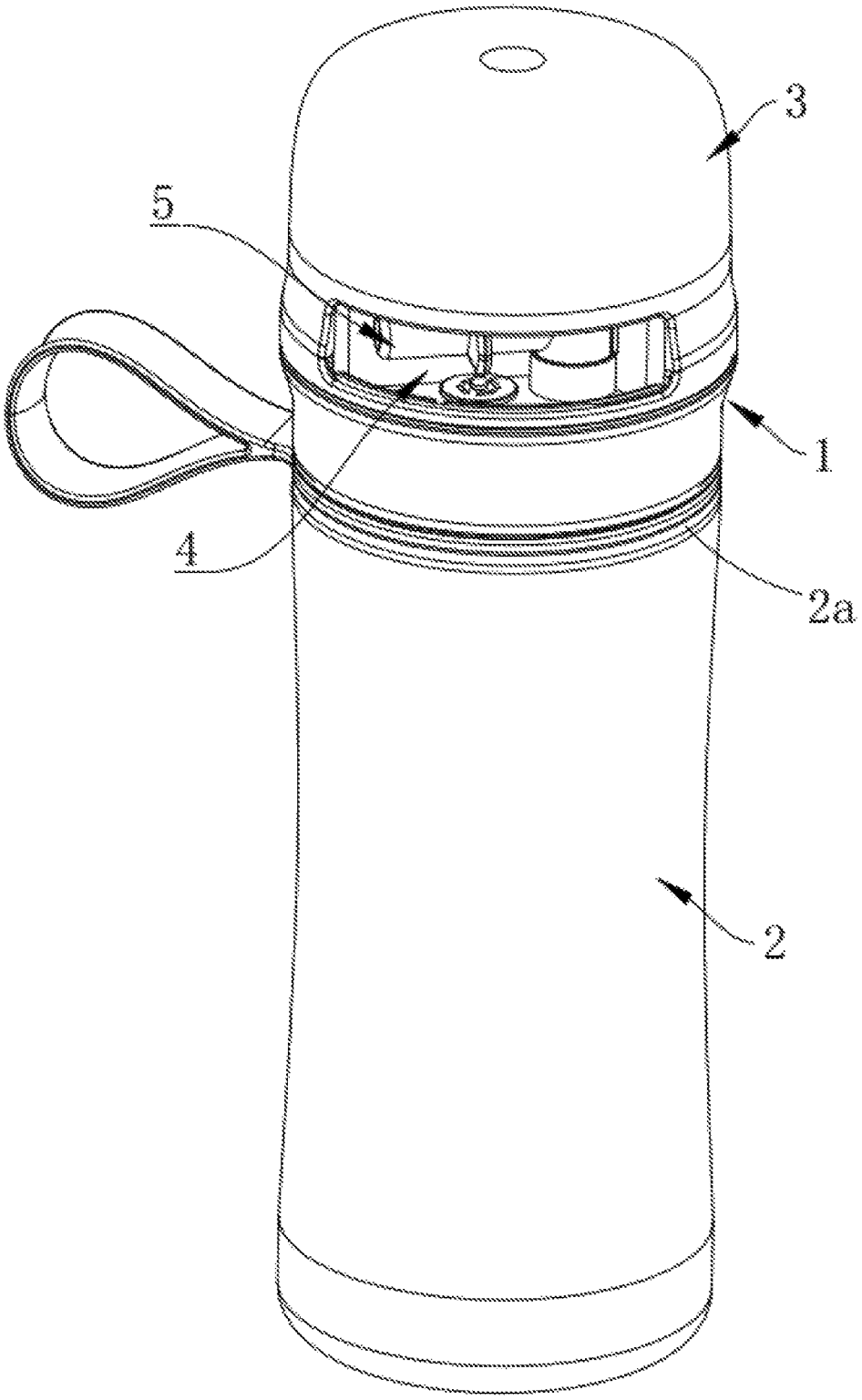
FIG. 1 is a schematic view of the cup-cover fan in accordance with a first exemplary embodiment.
Figure 2:
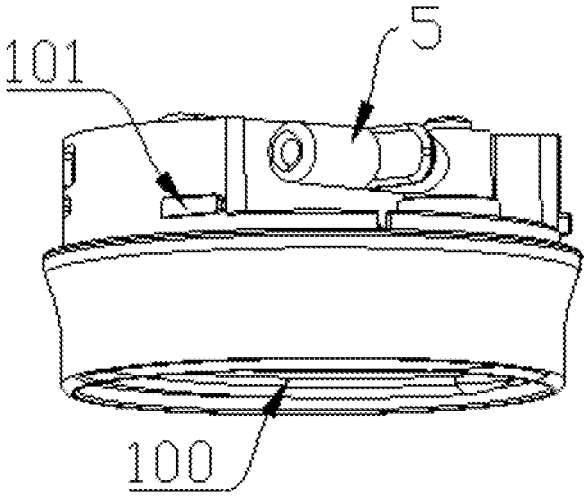
FIG. 2 is an installation schematic view of a suction nozzle end of the cup-cover fan of FIG. 1.
Figure 3:
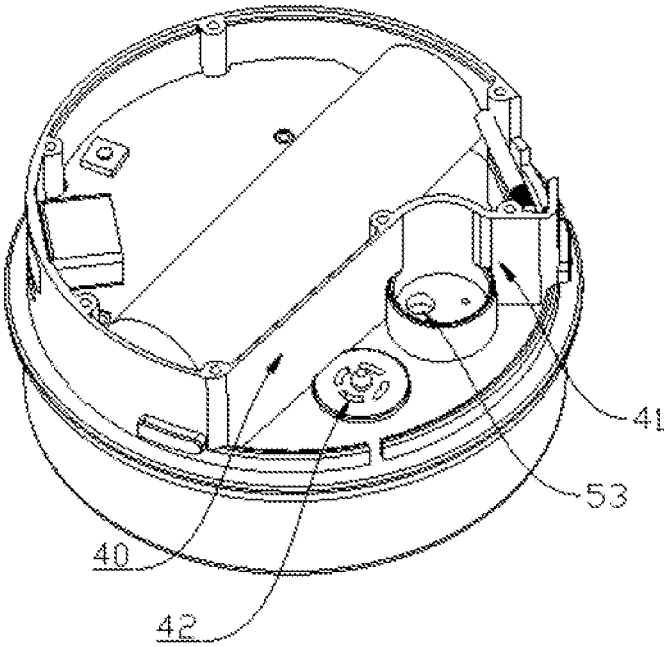
FIG. 3 is a schematic view of a chamber of a base of the cup-cover fan of FIG. 1.
Figure 4:
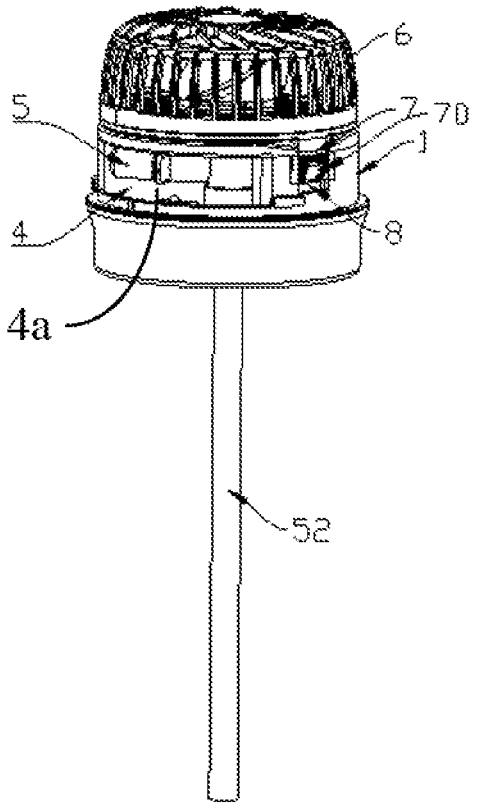
FIG. 4 is an assembly schematic view of a fan housing, the base and a straw of the cup-cover fan of FIG. 1.
Figure 5:
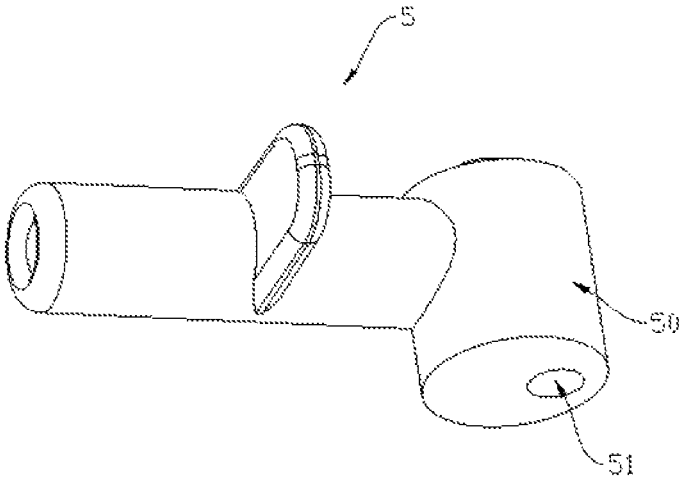
FIG. 5 is a schematic view of the suction nozzle end of the cup-cover fan of FIG. 1.
Figure 6:
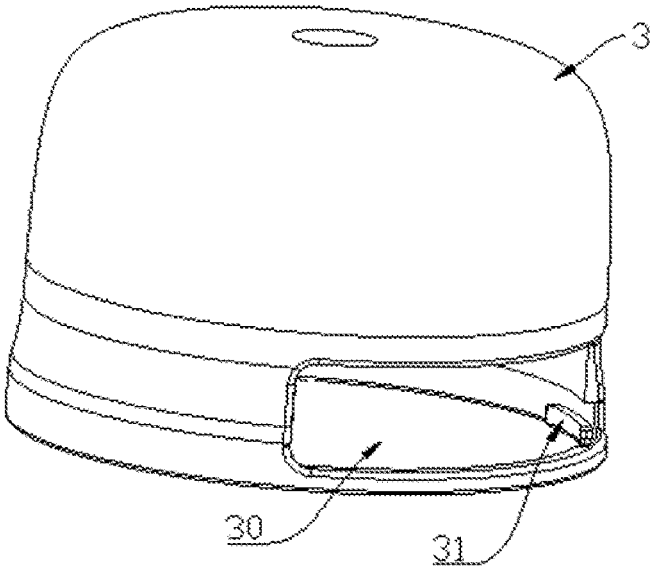
FIG. 6 is a schematic view of an upper cover of the cup-cover fan of FIG. 1.

The element labels according to the exemplary embodiment of the present disclosure shown as below:

base 1, connecting member 1*a*, shaft hole 1*b*, sleeving portion 100, PCB 100*a*, limiting block 101, heat insulating chamber 102, power supply 103, cup body 2, rim of a cup 2*a*, upper cover 3, window 30, fixing block 31, chamber 4, opening 4*a*, long sidewall 40, short sidewall 41, air hole 42, suction nozzle end 5, straw 5*a*, hard tube portion 5*b*, inner end 50, inlet 51, main body 52, through-water hole 53, outer end 54, notch 540, fan blade assembly 6*a*, horizontal rotating shaft 6*b*, elastic gasket 6*c*, fan housing 6, impeller 60, rotating frame 7, rotating member 7*a*, horizontal ridge 70, horizontal fixing shaft 71, installing portion 71*a*, fixing plate 8, pushing plate 9, back plate 10, protrusion 11, clasp structure 200*a*, movable valve 200*b*.

DETAILED DESCRIPTION

The disclosure is illustrated by way of example and not by way of limitation in the figures of the accompanying drawings, in which like reference numerals indicate similar elements.

Referring to FIGS. 1-12 and FIGS. 13-14, a cup-cover fan in accordance with an exemplary embodiment is provided and includes a base 1, a fan blade assembly 6*a* positioned on an upper portion of the base 1, a PCB 100*a* and a power supply 103 respectively connected to the fan blade assembly 6*a* and received in the base 1. The base 1 includes a cap portion 100*b* formed on the bottom thereof to cover a rim of a cup 2*a* of a cup body 2. The fan blade assembly 6*a* includes a fan housing 6 and an impeller 60 installed in the fan housing 6. The cap portion 100*b* is a sleeving portion arranged on the periphery of the rim of the cup 2*a* or a sleeve arranged inner of the rim of the cup 2*a*. The fan housing 6 is rotatably connected with the base 1 by a connecting member 1*a* to achieve opening and closing between the fan housing 6 and an upper surface of the base 1 via the fan housing 6 foldably rotating along the connecting member 1*a* to further adjust wind direction of the cup-cover fan. A clasp structure 200*a* is respectively formed on each opening and closing side (an opposite side of the joint between the fan housing and the base) of the fan housing 6 and the bottom of the base 1 to be mutually matched with each other for fixing the fan housing 6 in a closed state with the base 1 to prevent the fan housing 6 from freely opening. The matched clasp structure 200*a* is more common, which can be used in a combination of a concave structure and a convex structure.

Comparing to the solution of the related art, in the present disclosure, the impeller 60 (that is, the fan blade) is placed inside the fan housing 6 to improve protection and safety of the cup-cover fan. Furthermore, the fan housing 6 can rotate along the connecting member 1*a* to open and close it relative to the upper surface of the base 1. Such a book-turning operation can flexibly adjust the wind direction of the cup-cover fan, facilitate the collection of fans and reduce the occupation of space. A connection way of the base 1 and the cup body 2 can be realized by common means such as thread-connection, snap-connection, etc.

The connecting member 1*a* includes a rotating member 7*a* formed on the fan housing 6, an installing portion 71*a* formed on the base 1 to movably engage with the rotating member 7*a*. Although the rotation of the fan housing 6 can adjust the wind direction of the cup-cover fan, but if the fan housing 6 can't be fixed in a certain rotation angle of the fan housing 1 rather requiring manual support or other support, thereby the convenience of the cup-cover fan is greatly reduced. In this condition, as a preferred embodiment of the present disclosure, the connecting member 1*a* further includes a limiting member provided for stabilizing a rotation angle of fan housing 6.

The limiting member can be set as the following below:

First, the installing portion 71*a* is a horizontal fixing shaft 71 formed on the base 1 and the rotating member 7*a* is a rotating frame 7 formed on the fan housing 6 and passing through the horizontal fixing shaft 71. The limiting member includes a plurality of horizontal ridges 70 formed on an outer surface of the rotating frame 7 and a fixing plate 8 formed on the base 1 to suitably embed into a corresponding horizontal ridge 70. During rotation of the rotating frame 7 along the horizontal fixing shaft 71, the fixing plate 8 can be matched with the plurality of horizontal ridges 70 one by one. When a certain opening angle of the fan housing 6 is selected and then the external force is removed. At this time, the fixing plate 8 is tightly and stably fixed to the corresponding horizontal ridge 70 to prevent the fan housing 6 from optionally moving, thereby a stable wind direction of the fan blade assembly 6*a* is ensured.

Second, the rotating member 7*a* is a horizontal rotating shaft 6*b* formed on the fan housing 6 and the installing portion 71*a* is a shaft hole 1*b* formed on the base 1. The limiting member is an elastic gasket 6*c* abutting against the horizontal rotating shaft 6*b*. The elastic gasket 6*c* is fixed on the base 1 and located below the horizontal rotating shaft 6*b* to apply a continuous compression force on the horizontal rotating shaft 6*b*. Because the elastic gasket 6*c* is made of elastic material, the horizontal rotating shaft 6*b* can still rotate along the shaft hole 1*b* to adjust the wind direction of the fan housing 6 when external force is intervened. At this time, the elastic gasket 6*c* is in a compression deformation state. When the horizontal rotating shaft 6*b* is turned to an appropriate position and then the external force is withdrawn, the reset elastic gasket 6*c* can continue to press the horizontal rotating shaft 6*b* to avoid its arbitrary rotation.

The difference between the first exemplary embodiment, the second exemplary embodiment and the third exemplary embodiment mainly lies in setting ways of the suction nozzle end 5.

A straw 5*a* is mounted on the base 1 and connected with the cup body 2, and the suction nozzle end 5 of the straw 5*a* is configured to move to control opening and closing of the straw 5*a*. The suction nozzle end 5 is installed in a chamber 4 of the base 1, and the chamber 4 includes an opening 4*a* that the suction nozzle end 5 can be exposed therefrom when the straw 5*a* is in an open state. When using the straw 5*a*, water can be suck out from the cup body 2 only when external pressure entering the cup. In an exemplary embodiment of the present disclosure, the base 1 includes an air hole 42, which is generally set in the chamber 4, connected with the cup body 2, and a movable valve 200*b* formed below the air hole 42 to control opening and closing of the straw according to an actual usage state of the straw 5*a*. When drinking water, external air can open the movable valve 200*b* through the air hole 42 to enter the cup body 2, and then the water is flowed out through the straw 5*a*. While, when not drinking water, the movable valve 200*b* can adhere to the air hole 42 to prevent water flow out.

In the first exemplary embodiment of the present disclosure, the straw 5*a* includes the suction nozzle end 5 and a main body 52 extending into the cup body 2 and connected under a through-water hole 53 of the base 1 so that the suction nozzle end 5 can move to control correspondence and dislocation of an inlet 51 of the suction nozzle end 5 and the through-water hole 53. The suction nozzle end 5 can be arranged to slide in the chamber 4, for example, the suction nozzle end 5 is slid outwards until it is exposed from the opening 4*a* of the chamber 4, at this time, the inlet 51 is just corresponding to the through-water hole 53. And then the suction nozzle end 5 is continued to slide inwards until it is received in the chamber 4, at this time, the inlet 51 is dislocated with the through-water hole 53 so that the water can't flow out.

In a preferred embodiment of the present disclosure, the inlet 51 and the through-water hole 53 are eccentrically arranged each other and the suction nozzle end 5 includes an inner end 50 rotatably installed in the chamber 4. That is, the through-water hole 53 and the inlet 51 are eccentrically arranged each other along an axis of the inner end 50 so that the suction nozzle end 5 can rotate back and forth to realize correspondence and dislocation of the inlet 51 and the through-water hole 53. For example, the inner end 50 of the suction nozzle end 5 is longitudinally installed in the chamber 4 to control a lateral rotation back and forth of an outer end 54 of the suction nozzle end 5.

Figure 7:
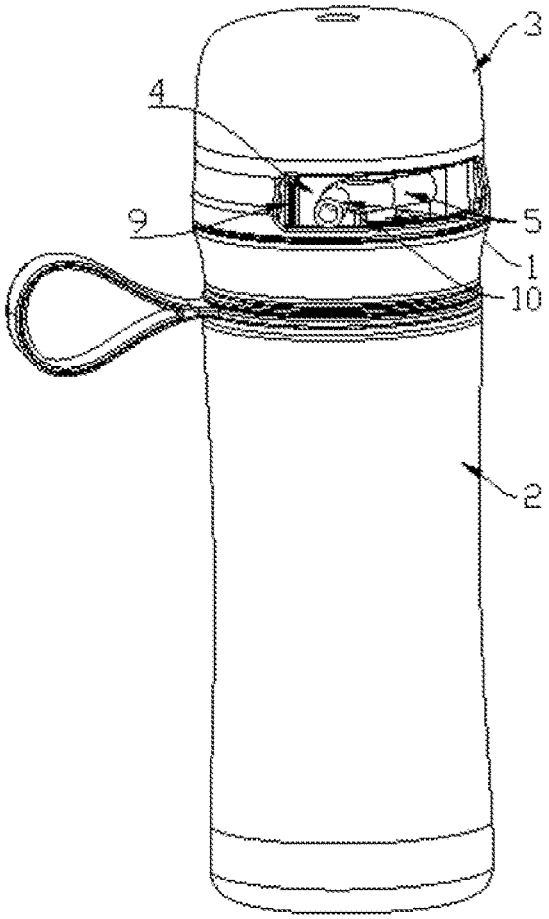
FIG. 7 is a schematic view of the cup-cover fan in accordance with a second exemplary embodiment.
Figure 8:
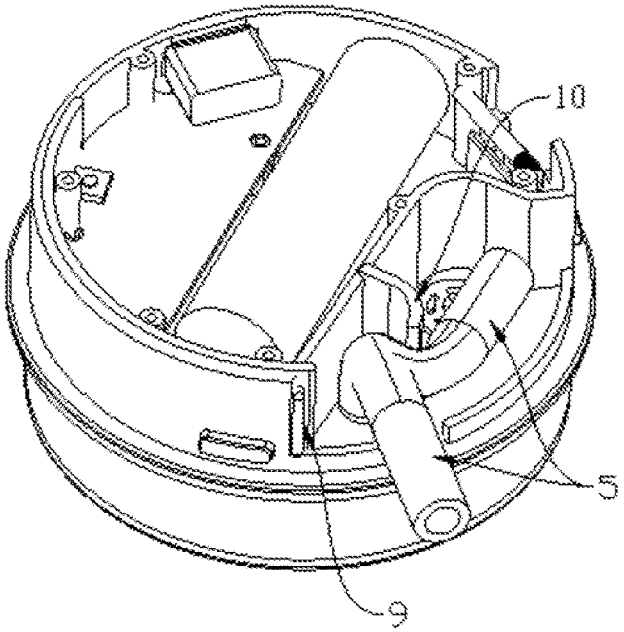
FIG. 8 is a schematic view of a suction nozzle end of the cup-cover fan of FIG. 7.
Figure 9:
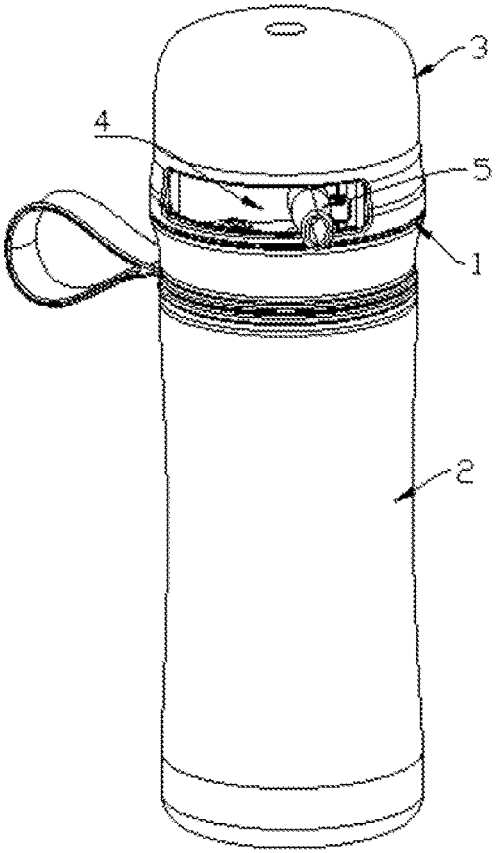
FIG. 9 is a schematic view of the cup-cover fan in accordance with a third exemplary embodiment.
Figure 10:
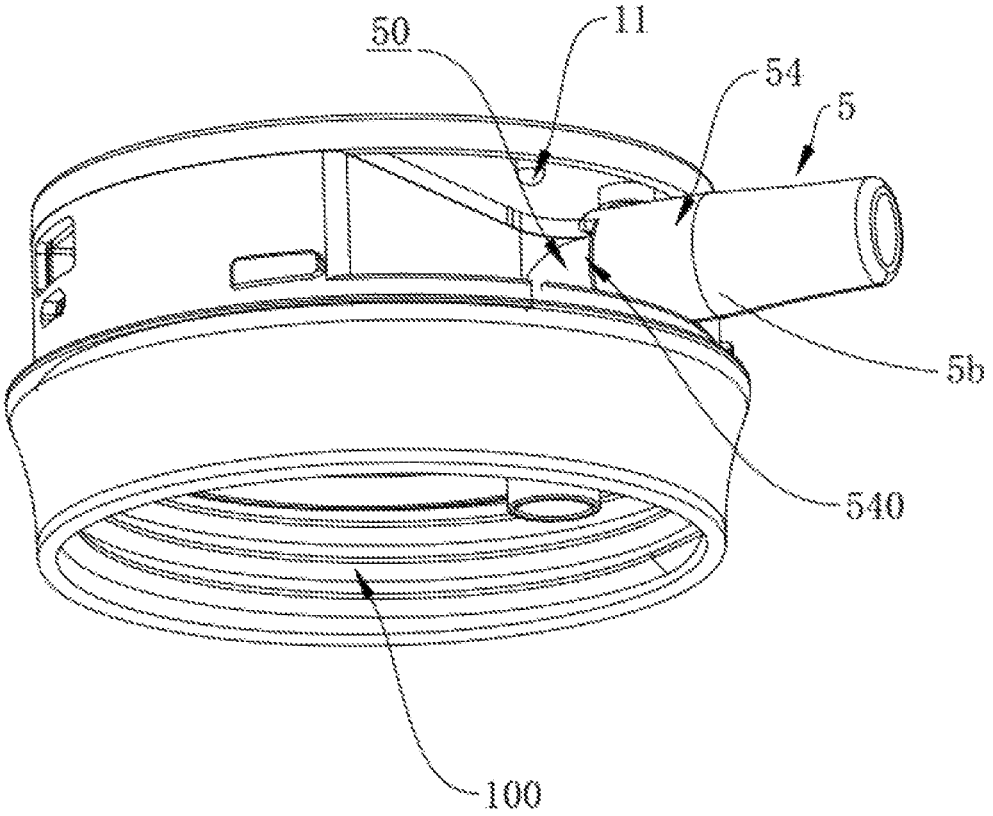
FIG. 10 is a schematic view of a suction nozzle end of the cup-cover fan of FIG. 9, shown the suction nozzle end in an open state.
Figure 11:
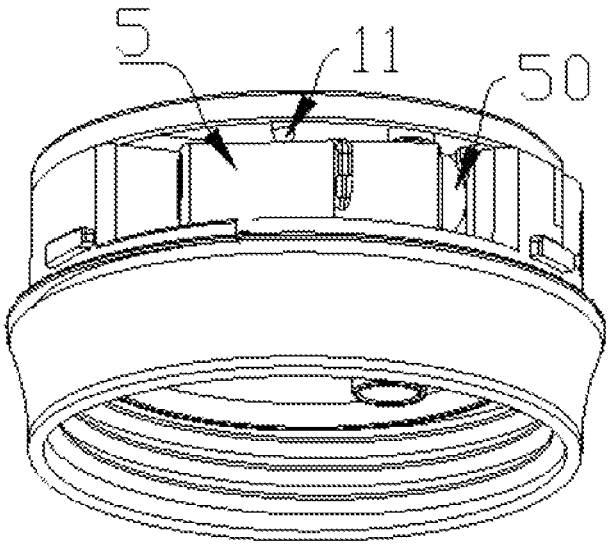
FIG. 11 is similar to FIG. 10, but shown the suction nozzle end bended and in a close state.
Figure 12:
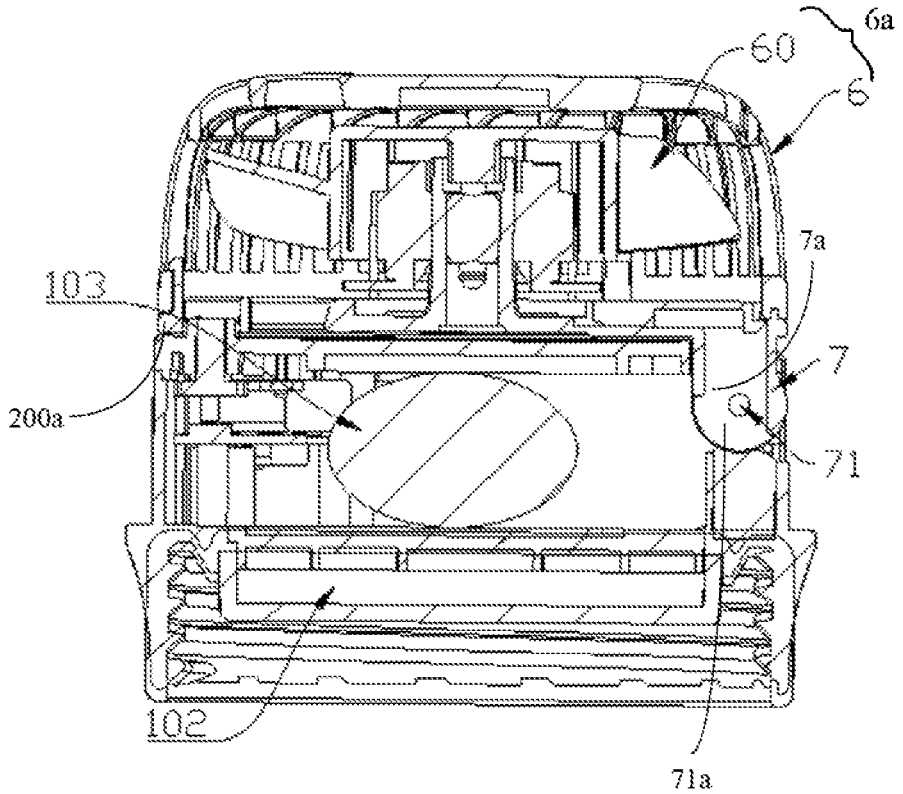
FIG. 12 is an exploded, schematic view of the cup-cover fan with a heat insulating chamber of FIG. 1.
Figure 13:
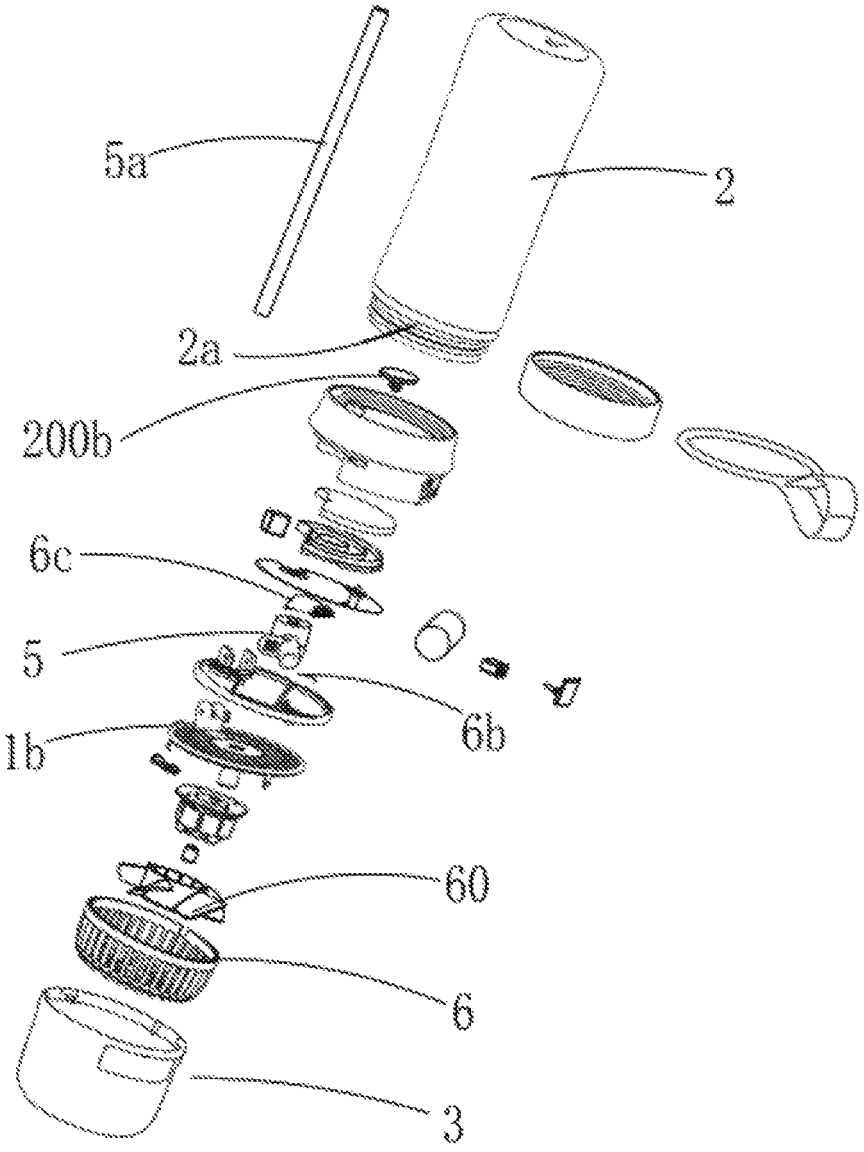
FIG. 13 is an exploded, schematic inverted view of the cup-cover fan of FIG. 1.
Figure 14:
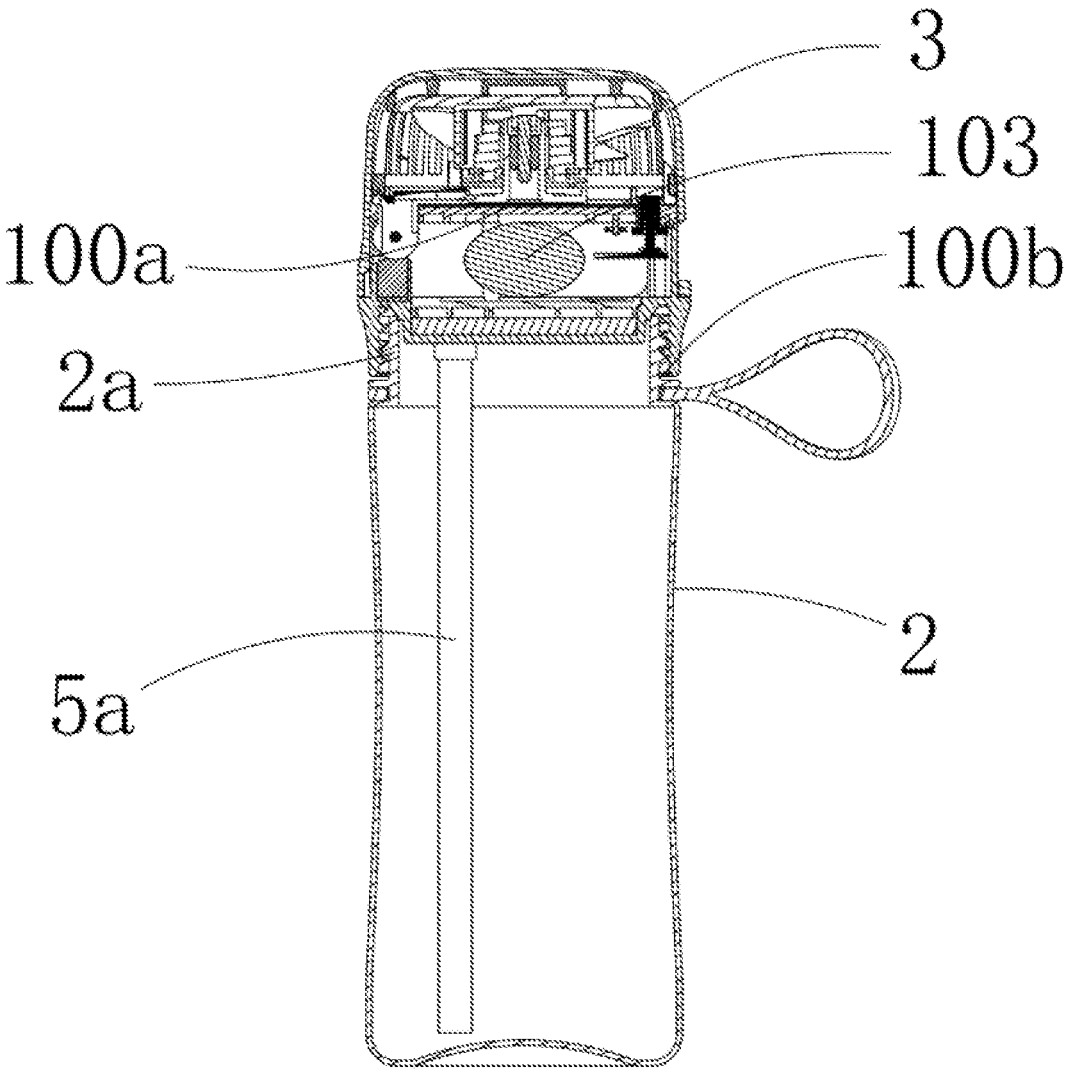
FIG. 14 is a cross-sectional view of the cup-cover fan of FIG. 1.

In the second exemplary embodiment of the present disclosure, the suction nozzle end 5 is a bendable hose and the chamber 4 includes a back plate 10 for bearing force when the suction nozzle end 5 is bent, and a pushing plate 9 is movably installed in the opening 4*a* of the chamber 4 corresponding to the back plate 10 and can move back and forth to bend and release the suction nozzle end 5. Referring to FIGS. 7-8 (two states of the suction nozzle end 5 simultaneously shown in the figures), the pushing plate 9 is pushed to move forward to bend the suction nozzle end 5 into the chamber 4 and maintain in such a state, until the suction nozzle end 5 is bent to close the straw, at this time, the water can't flow out. Furthermore, the pushing plate 9 is moved back to release its force applied on the suction nozzle end 5, and then the suction nozzle end 5 is reset to its original state and exposed out of the opening 4*a* to open the straw. The back plate 10 is provided as a point of force required by the suction nozzle end 5 when the suction nozzle end 5 is bent in order to ensure a controllable and reliable bending effect.

In the third exemplary embodiment of the present disclosure, the suction nozzle end 5 includes a hard tube portion 5*b* formed on the outer end 54 thereof and the chamber 4 includes a protrusion 11 corresponding to the hard tube portion 5*b* and limited the bent state of the suction nozzle end 5. The hard tube portion 5*b* can be formed by wrapping a piece of hard plastic around the outside of a bendable hose. When the suction nozzle end 5 is bent by manual operation along a hose section of the bendable hose, the hard tube portion 5*b* can apply a compression effect on the hose section at the bending joint so that the closed effect of the straw 5*a* can be better. The protrusion 11 can be set at the top or bottom of the chamber 4, while the suction nozzle end 5 is stuck after it is horizontally bended so that it can't be automatically reset. The hard tube portion 5*b* includes a notch 540 formed near the inner end 50 corresponding to a bending direction of the suction nozzle end 5 to reduce resistance during bending of the suction nozzle end 5.

It can be realize that suction nozzle end 5 is exposed out of the opening 4*a* of the chamber 4 by a plurality of ways during opening the suction nozzle end 5, as long as the chamber 4 has enough space to receive the suction nozzle end 5, and the distance from a mounting portion of the suction nozzle end 5 to its opening is less than the length of the suction nozzle end 5. For example, in the first exemplary embodiment of the present disclosure, the chamber 4 includes a long sidewall 40 and a short sidewall 41. The suction nozzle end 5 is installed near a corner between the long sidewall 40 and the short sidewall 41. The length of the suction nozzle end 5 is less than that of the long sidewall 40, but greater than that of the short sidewall 41. When the suction nozzle end 5 is rotated close to the long sidewall 40, the suction nozzle end 5 is in its closed state, while the suction nozzle end 5 is in its open state when it is rotated near to the short sidewall 41.

In some exemplary embodiments of the present disclosure, the cup-cover fan further includes an upper cover 3 covered on the base 1. The upper cover 3 includes a window 30 formed on a side wall thereof to match with the opening 4*a* of the chamber 4, and the upper cover 3 is rotated to achieve correspondence and dislocation of the window 30 and the opening 4*a*. The base 1 includes a plurality of limiting blocks 101 arranged on an outer wall thereof at intervals, and the upper cover 3 includes a plurality of fixing blocks 31 formed on an inner wall thereof to engage with corresponding limiting blocks 101. A space between each two adjacent limiting blocks 101 is sufficient for entry and exit of a corresponding fixing block 31 so that the upper cover 3 can rotate to perform clamp connection of the limiting block 101 and the fixing block 31. In this way, the base 1 and the upper cover 3 can be tightly fixed each other by the limiting block 101 clamping with the fixing block 31. First, the limiting block 101 and the fixing block 30 are staggered each other so that the upper cover 3 is covered onto the base 1, and then the upper cover 3 is rotated so that the two structures are buckled together to prevent the upper cover 3 from being freely detached from the base 1.

In some exemplary embodiments of the present disclosure, a heat insulating chamber 102 is formed between the cap portion and the PCB, and the power supply 103, and a power supply chamber is formed on the base 1. Such heat insulating chamber 102 is provided to reduce an influence of heat generated by a drink in the cup body 2 on the power supply to ensure normal operation of the cup-cover fan. The power supply is typically a lithium electrical battery which can be repeatedly recharged. The base 1 includes a charging input port connected to the PCB for power supply, and a charging output port used as a mobile power source to charge other electronic devices.

Furthermore, a bendable lifting belt can be attached to the cup body 2 of the cup-cover fan and secured at the rim of the cup to facilitate portability.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A cup-cover fan, comprising:

a base comprising a cap portion formed on the bottom thereof to cover a rim of a cup;

a fan blade assembly positioned on an upper portion of the base and comprising a fan housing and an impeller installed in the fan housing;

a printed circuit board and a power supply connected to the fan blade assembly and received in the base; and wherein the cap portion is a sleeving portion arranged on the periphery of the rim of the cup or a sleeve arranged inner of the rim of the cup, and the fan housing is rotatably connected with the base by a connecting member to achieve opening and closing between the fan housing and an upper surface of the base via the fan housing foldably rotating along the connecting member to adjust wind direction of the cup-cover fan.

2. The cup-cover fan as claimed in claim 1, wherein a straw is mounted on the base and connected with a cup body, a suction nozzle end of the straw configured to move to control opening and closing of the straw.

3. The cup-cover fan as claimed in claim 2, wherein the suction nozzle end is installed in a chamber of the base, and the chamber comprises an opening that the suction nozzle end can be exposed therefrom when the straw is in an open state.

4. The cup-cover fan as claimed in claim 3, wherein the straw comprises a main body extending into the cup body and connected under a through-water hole of the base so that the suction nozzle end can move to control correspondence and dislocation of an inlet of the suction nozzle end and the through-water hole.

5. The cup-cover fan as claimed in claim 4, wherein the suction nozzle end comprises an inner end rotatably installed in the chamber, and the through-water hole and the inlet are eccentrically arranged each other relative to an axis of the inner end so that the suction nozzle end can rotate back and forth to realize correspondence and dislocation of the inlet and the through-water hole.

6. The cup-cover fan as claimed in claim 3, wherein the cup-cover fan further comprises an upper cover covered on the base.

7. The cup-cover fan as claimed in claim 6, wherein the base comprises a plurality of limiting blocks arranged on an outer wall thereof at intervals, and the upper cover comprises a plurality of fixing blocks formed on an inner wall thereof to engage with corresponding limiting blocks, a space between each two adjacent limiting blocks is sufficient for entry and exit of a corresponding fixing block so that the upper cover can rotate to perform clamp connection of the limiting block and the fixing block.

8. The cup-cover fan as claimed in claim 6, wherein the upper cover comprises a window formed on a side wall thereof to match with the opening of the chamber, and the upper cover is rotated to achieve correspondence and dislocation of the window and the opening.

9. The cup-cover fan as claimed in claim 2, wherein the suction nozzle end is a bendable hose and the base comprises a limiting portion for limiting the suction nozzle end in a bent state.

10. The cup-cover fan as claimed in claim 9, wherein the chamber comprises a back plate for bearing force when the suction nozzle end is bent, and the limiting portion is a pushing plate movably installed in the opening of the chamber and can move back and forth to bend and release the suction nozzle end.

11. The cup-cover fan as claimed in claim 9, wherein the suction nozzle end comprises a hard tube portion formed on an outer end thereof, and the limiting portion is a protrusion formed on the chamber, with the hard tube portion corresponding to the protrusion during in the bent state of the suction nozzle end.

12. The cup-cover fan as claimed in claim 2, wherein the base further comprises an air hole connected with the cup body and a movable valve formed below the air hole to control opening and closing of the straw according to an actual usage state of the straw.

13. The cup-cover fan as claimed in claim 1, wherein a heat insulating chamber is formed between the cap portion and the printed circuit board and the power supply.

14. The cup-cover fan as claimed in claim 1, wherein the connecting member comprises a rotating member formed on the fan housing, an installing portion formed on the base to movably engage with the rotating member, and a limiting member provided for stabilizing a rotation angle of the rotating member.

15. The cup-cover fan as claimed in claim 14, wherein the installing portion is a horizontal fixing shaft formed on the base and the rotating member is a rotating frame formed on the fan housing and passing through the horizontal fixing shaft, and the limiting member comprises a plurality of horizontal ridges formed on an outer surface of the rotating frame and a fixing plate formed on the base to suitably embed into a corresponding horizontal ridge.

16. The cup-cover fan as claimed in claim 14, wherein the rotating member is a horizontal rotating shaft formed on the fan housing, the installing portion is a shaft hole formed on the base, and the limiting member is an elastic gasket abutting against the horizontal rotating shaft.

17. The cup-cover fan as claimed in claim 1, wherein a clasp structure is respectively formed on an opening and closing side of the fan housing and the base to be mutually matched with each other.

18. A water cup, comprising:

a cup body; and a cup-cover fan connected to a rim of the cup, the cup-cover fan comprising:

a base comprising a cap portion formed on the bottom thereof to cover a rim of a cup;

a fan blade assembly positioned on an upper portion of the base and comprising a fan housing and an impeller installed in the fan housing;

a printed circuit board and a power supply respectively connected to the fan blade assembly and received in the base; and wherein the cap portion is a sleeving portion arranged on the periphery of the rim of the cup or a sleeve arranged inner of the rim of the cup, and the fan housing is rotatably connected with the base by a connecting member to achieve opening and closing between the fan housing and an upper surface of the base via the fan housing foldably rotating along the connecting member to adjust wind direction of the cup-cover fan.

19. The water cup as claimed in claim 18, wherein a straw is mounted on the base and connected with a cup body, a suction nozzle end of the straw configured to move to control opening and closing of the straw.

20. The water cup as claimed in claim 19, wherein the suction nozzle end is installed in a chamber of the base, and the chamber comprises an opening that the suction nozzle end can be exposed therefrom when the straw is in an open state.

21. The water cup as claimed in claim 20, wherein the straw comprises a main body extending into the cup body and connected under a through-water hole of the base so that the suction nozzle end can move to control correspondence and dislocation of an inlet of the suction nozzle end and the through-water hole.

22. The water cup as claimed in claim 21, wherein the suction nozzle end comprises an inner end rotatably installed in the chamber, and the through-water hole and the inlet are eccentrically arranged each other relative to an axis of the inner end so that the suction nozzle end can rotate back and forth to realize correspondence and dislocation of the inlet and the through-water hole.

23. The water cup as claimed in claim 20, wherein the cup-cover fan further comprises an upper cover covered on the base.

24. The water cup as claimed in claim 23, wherein the base comprises a plurality of limiting blocks arranged on an outer wall thereof at intervals, and the upper cover comprises a plurality of fixing blocks formed on an inner wall thereof to engage with corresponding limiting blocks, a space between each two adjacent limiting blocks is sufficient for entry and exit of a corresponding fixing block so that the upper cover can rotate to perform clamp connection of the limiting block and the fixing block.

25. The water cup as claimed in claim 23, wherein the upper cover comprises a window formed on a side wall thereof to match with the opening of the chamber, and the upper cover is rotated to achieve correspondence and dislocation of the window and the opening.

26. The water cup as claimed in claim 19, wherein the suction nozzle end is a bendable hose and the base comprises a limiting portion for limiting the suction nozzle end in a bent state.

27. The water cup as claimed in claim 26, wherein the chamber comprises a back plate for bearing force when the suction nozzle end is bent, and the limiting portion is a pushing plate movably installed in the opening of the chamber and can move back and forth to bend and release the suction nozzle end.

28. The water cup as claimed in claim 26, wherein the suction nozzle end comprises a hard tube portion formed on an outer end thereof, and the limiting portion is a protrusion formed on the chamber, with the hard tube portion corresponding to the protrusion during in the bent state of the suction nozzle end.

29. The water cup as claimed in claim 19, wherein the base further comprises an air hole connected with the cup body and a movable valve formed below the air hole to control opening and closing of the straw according to an actual usage state of the straw.

30. The water cup as claimed in claim 18, wherein a heat insulating chamber is formed between the cap portion and the printed circuit board and the power supply.

31. The water cup as claimed in claim 18, wherein the connecting member comprises a rotating member formed on the fan housing, an installing portion formed on the base to movably engage with the rotating member, and a limiting member provided for stabilizing a rotation angle of the rotating member.

32. The water cup as claimed in claim 31, wherein the installing portion is a horizontal fixing shaft formed on the base and the rotating member is a rotating frame formed on the fan housing and passing through the horizontal fixing shaft, and the limiting member comprises a plurality of horizontal ridges formed on an outer surface of the rotating frame and a fixing plate formed on the base to suitably embed into a corresponding horizontal ridge.

33. The water cup as claimed in claim 31, wherein the rotating member is a horizontal rotating shaft formed on the fan housing, the installing portion is a shaft hole formed on the base, and the limiting member is an elastic gasket abutting against the horizontal rotating shaft.

34. The water cup as claimed in claim 18, wherein a clasp structure is respectively formed on an opening and closing side of the fan housing and the base to be mutually matched with each other.

* * * * *